US009993099B2

(12) United States Patent
Lordi

(10) Patent No.: US 9,993,099 B2
(45) Date of Patent: Jun. 12, 2018

(54) CAKE TRANSPORTING DEVICE

(71) Applicant: Elizabeth Lordi, Ellwood, PA (US)

(72) Inventor: Elizabeth Lordi, Ellwood, PA (US)

( * ) Notice: Subject to any disclaimer, the term of this patent is extended or adjusted under 35 U.S.C. 154(b) by 0 days. days.

(21) Appl. No.: 14/734,139

(22) Filed: Jun. 9, 2015

(65) Prior Publication Data

US 2015/0351569 A1 Dec. 10, 2015

Related U.S. Application Data

(60) Provisional application No. 62/009,545, filed on Jun. 9, 2014.

(51) Int. Cl.

| | |
|---|---|
| ***B65D 25/10*** | (2006.01) |
| ***B65D 25/24*** | (2006.01) |
| ***A47G 19/26*** | (2006.01) |
| *B65D 5/20* | (2006.01) |

(52) U.S. Cl.

CPC ..... *A47G 19/26* (2013.01)

(58) Field of Classification Search

CPC ..... B65D 73/0014; B65D 85/36; B65D 7/26; B65D 11/1846; A47G 19/30; A47G 19/26

USPC ..... 220/62, 7, 662, 6; D9/433, 432; D7/610; 206/766, 495

See application file for complete search history.

(56) References Cited

U.S. PATENT DOCUMENTS 648,712 A * 5/1900 Rivers ..... B65D 33/001 206/493
1,726,523 A * 9/1929 Blows ..... B65D 63/10 206/499
D155,246 S * 9/1949 Miklos ..... 206/766
2,924,330 A * 2/1960 Ballard ..... A47G 19/00 206/493
3,330,610 A * 7/1967 Schnabel ..... A47G 19/26 220/293
3,360,180 A * 12/1967 Venturi ..... B65D 1/225 220/6
3,627,541 A * 12/1971 Farquhar ..... B65D 5/2057 229/103
3,990,683 A * 11/1976 Ravreby ..... A61F 13/041 206/219
4,359,159 A * 11/1982 Pollard ..... B65D 85/36 206/551
4,614,266 A * 9/1986 Moorhead ..... B65D 79/00 206/216

(Continued)

*Primary Examiner* — J. Gregory Pickett
*Assistant Examiner* — Niki M Eloshway
(74) *Attorney, Agent, or Firm* — Global Intellectual Property Agency, LLC; Jordan Sworen

(57) ABSTRACT

A cake transporting device for use in transporting cakes of various sizes. The cake transporting device includes an enclosure having a base, foldable side panels, and a removable lid, defining an interior volume in which a cake can be positioned for transportation. Once a cake is positioned on the base, pins are inserted into apertures disposed on the base so as to surround or encircle the cake, thereby preventing the cake from shifting during transportation. The side panels on the base are movable between an open configuration wherein the panels lie in the same plane as the base, and a closed configuration wherein the panels are folded so as to form a three dimensional shape. Each panel includes a strap having a mating fastener thereon, wherein the mating fasteners on opposing panels are engaged so as to secure the enclosure in the closed configuration.

12 Claims, 2 Drawing Sheets

(56) References Cited

U.S. PATENT DOCUMENTS

| | | | | | |
|---|---|---|---|---|---|
| 5,174,196 | A * | 12/1992 | Cheatham | A22C 17/006 | 99/419 |
| 5,328,042 | A * | 7/1994 | Heise | B65D 5/36 | 220/4.28 |
| 5,343,815 | A * | 9/1994 | Dickinson | A47G 19/30 | 108/101 |
| 5,685,453 | A * | 11/1997 | Goins | B29C 51/00 | 220/671 |
| 5,746,342 | A * | 5/1998 | Jacques | B65D 11/1833 | 220/6 |
| 5,865,889 | A * | 2/1999 | Birtalan | A21C 9/04 | 118/13 |
| 2004/0222121 | A1* | 11/2004 | Horton | B65D 5/5028 | 206/525 |
| 2015/0175292 | A1* | 6/2015 | McCullough | B65D 5/22 | 426/128 |

* cited by examiner

CAKE TRANSPORTING DEVICE

CROSS REFERENCE TO RELATED APPLICATION

This application claims the benefit of U.S. Provisional Application No. 62/009,545 filed on Jun. 9, 2014. The above identified patent application is herein incorporated by reference in its entirety to provide continuity of disclosure.

BACKGROUND OF THE INVENTION

Field of the Invention

The present invention relates to a cake transporting device. More specifically, the present invention provides a cake transporting device comprising a foldable enclosure that can be arranged in an open configuration or a closed configuration defining an interior volume in which a cake can be positioned for storage. The base of the enclosure includes a plurality of apertures adapted to receive pins therein, wherein the pins are positioned so as to surround a cake to prevent the cake from shifting during transportation.

It is often necessary to transport a cake or other baked goods from one location to another. Bakers, pastry chefs, and caterers often need to transport one or more cakes from their place of business to a reception hall, home, or other location. However, cakes can be easily damaged during transportation if the cake tips over, presses against a surface, or brushes against other objects. Thus, transporting a cake without damaging the same can be difficult, and a cake must be transported with care.

Conventional cake carrying devices provide a stable surface on which a cake can be positioned. However, these devices provide a flat surface on which the cake may shift or slide during transportation, resulting in damage to the cake. Other such devices are constructed for supporting cakes of a certain size and cannot be used with various sized cakes or with multiple cakes. Thus, the devices in the prior art do not provide adjustable securement means for securely transporting different sized and shaped cakes. As a result, a cake transporting device that can secure cakes of different sizes is desired.

Devices have been disclosed in the prior art that relate to cake holding or carrying devices. These include devices that have been patented and published in patent application publications. These devices generally relate to cake carriers or supports for holding and securing a cake therein, such as U.S. Pat. Nos. 5,706,966; 6,296,120; 8,545,914, 2011/0226659, and U.S. Design Pat. No. D318,399.

These prior art devices have several known drawbacks. The devices in the prior art fail to provide enclosures suited for holding cakes of various sizes. Some devices include wells or recessed areas in which baked goods can be positioned, however, such wells or recessed areas are only suited for holding a baked good of a specific size. Thus, the prior art devices fail to disclose a cake transporting device that can be adjusted so as to transport cakes of various shapes and sizes.

In light of the devices disclosed in the prior art, it is submitted that the present invention substantially diverges in design elements from the prior art and consequently it is clear that there is a need in the art for an improvement to existing cake transporting devices. In this regard the instant invention substantially fulfills these needs.

SUMMARY OF THE INVENTION

In view of the foregoing disadvantages inherent in the known types of cake transporting devices now present in the prior art, the present invention provides a new cake transporting device wherein the same can be utilized for providing convenience for the user when transporting cakes of various sizes using a single device.

It is therefore an object of the present invention to provide a new and improved cake transporting device comprising an enclosure having a base, foldable side panels, and a removable lid, defining an interior volume in which a cake can be positioned for transportation.

It is another object of the present invention to provide a cake transporting device comprising a base having a plurality of apertures thereon, wherein one or more pins can be inserted into the apertures adjacent to a cake positioned on the base so as to constrain the movement of the cake.

Another object of the present invention is to provide a cake transporting device comprising an enclosure having a base and foldable side panels, wherein the side panels can be folded flat in a planar orientation or folded into a three dimensional configuration so as to define an interior volume in which a cake can be positioned for transportation.

Yet another object of the present invention is to provide a cake transporting device comprising an enclosure having a plurality of straps having mating fasteners thereon that can be used to secure the enclosure in a closed configuration.

Another object of the present invention is to provide a cake transporting device that may be readily fabricated from materials that permit relative economy and are commensurate with durability.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
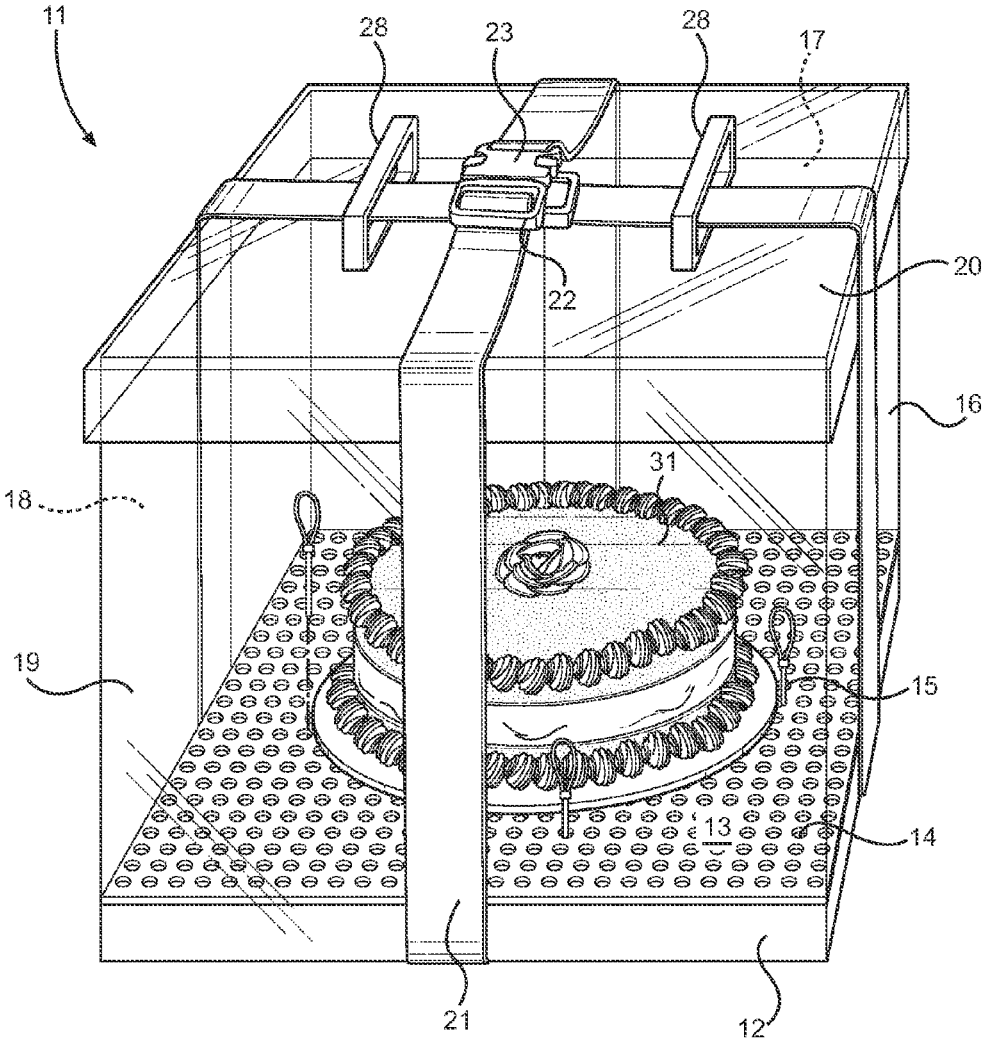
FIG. 1 shows a perspective view of the cake transporting device in a closed configuration.

Reference is made herein to the attached drawings. Like reference numerals are used throughout the drawings to depict like or similar elements of the cake transporting device. For the purposes of presenting a brief and clear description of the present invention, the preferred embodiment will be discussed as used for securely transporting a cake from one location to another. The figures are intended for representative purposes only and should not be considered to be limiting in any respect.

Referring now to FIG. 1, there is shown a perspective view of the cake transporting device in a closed configuration. The cake transporting device 11 comprises an enclosure having a base 12 and one or more side panels 16, 17, 18, 19 pivotally affixed to the perimeter of the base 12, wherein the side panels are movable between an open configuration and a closed configuration. In the open configuration, the panels 16, 17, 18, 19 lie flat and are planar with the base 12. In the closed configuration, the side panels 16, 17, 18, 19 are arranged perpendicularly to the base 12 and define a three dimensional enclosure having an interior volume in which a cake 31 can be positioned for transportation.

In the illustrated embodiment, the base 12 is substantially square in configuration. The enclosure is shown as having a front panel 19, a rear panel 17, a first side panel 16, and a second side panel 18 pivotally affixed to the edges of the base 12. Thus, the panels 16, 17, 18, 19 serve as the walls of the enclosure when the panels are arranged in the closed configuration. The side panels 16, 18 are preferably composed of a semi-rigid material so as to provide stability to the enclosure while also providing some degree of flexibility. Further, the panels 16, 17, 18, 19 are preferably composed of a transparent material so that the user can see the contents of the enclosure.

The cake transporting device 11 further includes a lid 20 removably positioned on the upper end of the panels. The lid 20 is adapted to enclose the upper end of the enclosure, and serves to stabilize and secure the panels 16, 17, 18, 19 in the closed configuration. In this way, a cake 31 can be fully protected within the interior volume of the enclosure so as to prevent the same from being damaged. The lid 20 preferably comprises a similar size and shape as the base 12 in order to fully cover the upper end of the enclosure. The lid 20 includes flanges disposed on the edges thereof that extend downward therefrom, wherein the flanges are adapted to further secure the lid 20 to the enclosure positioned in a closed configuration.

The cake transporting device 11 further includes a plurality of elongated straps 21 having a first end and a second end, wherein the first end is affixed to the base 12. Preferably, one elongated strap 21 is positioned on each side of the base 12, wherein each elongated strap 21 is adapted to engage with an elongated strap 21 disposed on an opposing side of the base 12. In the illustrated embodiment, four elongated straps 21 are provided, wherein each side of the base 12 includes an elongated strap 21 extending therefrom. Each elongated strap 21 includes a mating fastener 22, 23 on the second end thereof, wherein elongated straps 21 on opposing sides of the base 12 are adapted to be removably engaged with one another. Thus, the mating fastener 22 on the front panel 19 is removably engaged with the mating fastener 23 on the rear panel 17, wherein the mating fasteners 22, 23 are engaged centrally on the lid 20 of the enclosure. Similarly, the elongated strap 21 on the first side panel 16 is removably engaged with the elongated strap 21 on the second side panel 18 via the mating fasteners 22, 23. Preferably, the mating fasteners 22, 23 comprise a buckle 23 and a blade 22, wherein the blade 22 is insertable into the buckle 23. However, other suitable mating fasteners 22, 23 can be used in alternate embodiments.

One or more of the elongated straps 21 may further include a handle 28 thereon. The handle 28 is preferably positioned adjacent to the second end of the elongated strap so that the handles 28 are positioned on the lid 20 of the enclosure when the panels are in a closed configuration. In this way, the user can grasp the handles 28 on the upper end of the enclosure so as to more easily carry and transport the cake transporting device 11.

Figure 2:
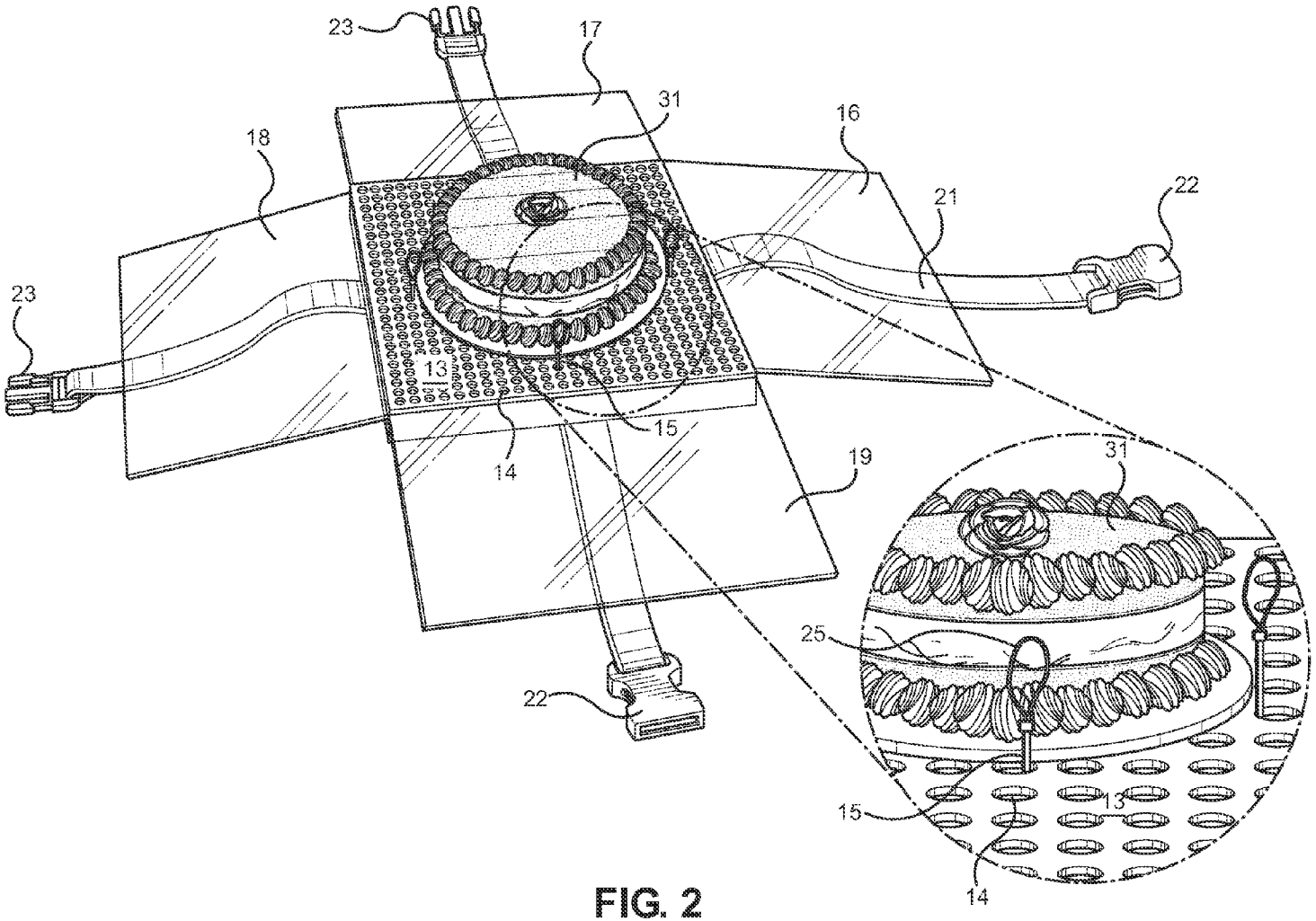
FIG. 2 shows a perspective view of the cake transporting device in an open configuration.

Referring now to FIG. 2, there is shown a perspective view of the cake transporting device in an open configuration. The base of the cake transporting device 11 comprises an upper surface 13 that is substantially planar so that a cake 31 can be placed thereon. The upper surface 13 further comprises a plurality of apertures 14. The apertures 14 are preferably arranged in a grid on the base such that the apertures 14 are spaced at a fixed interval.

The cake transporting device further comprises a plurality of pins 15, wherein each pin 15 includes an elongated shaft and a loop 25 on an upper end thereof. The loop 25 allows the user to more easily grasp and manipulate each pin 15. The pins 15 are adapted to be removably inserted into the apertures 14. In operation, the elongated shaft of the pin 15 is positioned within an aperture 14 located adjacent to the perimeter of the cake 31. By inserting several pins 15 around the perimeter of the cake 31, the cake 31 is restrained from movement and the cake 31 will be prevented from shifting or moving during transportation. Further, the use of the pins 15 allows the user to adjust the placement of the pins 15 depending upon the size and shape of the cake. Thus, the cake transporting device 11 can be used to transport cakes of various sizes and shapes, and can also be used to transport multiple cakes at a single time.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A cake transporting device, comprising:

a base having a plurality of apertures arranged in a grid pattern on an upper surface of the base, the grid pattern arrangement includes a plurality of spaces, each space of the plurality of spaces defining a distance between adjacent apertures of the plurality of apertures, wherein each distance of each space of the plurality of spaces is equal in length, such that all neighboring apertures to an aperture of the plurality of apertures are disposed at the same distance relative to the aperture;

wherein the plurality of apertures extend across the entire upper surface of the base from a side edge of the base to an opposing side edge of the base and around a perimeter of the base, such that the plurality of apertures form a second space between the perimeter of the base, the side edge, and opposing side edge of the base, that is substantially equal in length to the plurality of spaces of the grid pattern;

a plurality of pins removably insertable into the plurality of apertures, the plurality of pins configured to be arranged in a plurality of adjustable positions relative to the base;

a plurality of side panels pivotally affixed to the perimeter edge of the base, wherein the plurality of side panels are movable between an open configuration and a closed configuration about the perimeter edge of the base;

a lid removably securable to the plurality of side panels when the plurality of side panels are in a closed configuration, the lid configured to enclose the open upper end and the interior volume.

2. The cake transporting device of claim 1, wherein said plurality of side panels are transparent.

3. The cake transporting device of claim 2, wherein said lid is transparent.

4. The cake transporting device of claim 1, further comprising a plurality of elongated straps, each including a first end attached to the base and a second end, each second end including a complimentary mating fastener configured to secure the second ends over the lid, the plurality of elongated straps intersecting at a center of the lid when secured thereover.

5. The cake transporting device of claim 1, wherein said base comprises a square configuration.

6. The cake transporting device of claim 1, wherein said plurality of panels comprises a front panel, a rear panel, a first side panel, and a second side panel.

7. The cake transporting device of claim 6, further comprising a plurality of elongated straps wherein one of said plurality of elongated straps extends along each of said front panel, said rear panel, said first side panel, and said second side panel.

8. The cake transporting device of claim 7, wherein at least one of said plurality of elongated straps further includes a handle protruding outwardly therefrom.

9. The cake transporting device of claim 1, wherein each of said plurality of pins comprises an elongated shaft and a loop protruding upwardly from an end thereof, the loop defining an opening.

10. The cake transporting device of claim 1, wherein the lid includes a flange extending outwardly from a perimeter edge thereof, the flange configured to further secure the lid to the plurality of side panels when the plurality of panels are in the closed configuration.

11. The cake transporting device of claim 1, wherein the plurality of apertures include a plurality of horizontal columns of apertures and a plurality of vertical columns of apertures, the plurality of horizontal columns of apertures and the plurality of vertical columns of apertures including an equal amount of apertures;

wherein the plurality of horizontal columns of apertures include a horizontal column of apertures immediately adjacent a perimeter edge of the base, the horizontal column defining a third space in between the horizontal column and the perimeter edge, the second space including a length equal to the length of the plurality of spaces of the grid pattern;

wherein the plurality of vertical columns of apertures include a vertical column of apertures immediately adjacent the perimeter edge of the base, the vertical column defining a fourth space in between the vertical column and the perimeter edge, the fourth space including a length equal to the length of the plurality of spaces of the grid pattern.

12. The cake transporting device of claim 1, wherein in the open configuration a side edge of the plurality of side panels is coplanar relative to the base, and wherein in the closed configuration the plurality of side panels form an open upper end and an interior volume in which a cake can be positioned for storage.

* * * * *